US005189837A

United States Patent [19]

Ienaga

[11] Patent Number: 5,189,837

[45] Date of Patent: Mar. 2, 1993

[54] SINGLE SLIDING SASH

[75] Inventor: Tatsuhiko Ienaga, Kawasaki, Japan

[73] Assignee: Fujisash Co., Kanagawa, Japan

[21] Appl. No.: 845,501

[22] Filed: Feb. 28, 1992

Related U.S. Application Data

[63] Continuation of Ser. No. 589,774, Sep. 28, 1990, abandoned.

[30] Foreign Application Priority Data

Dec. 21, 1989 [JP] Japan ..... 1-332236

[51] Int. Cl.[5] ..... E05D 15/20

[52] U.S. Cl. ..... 49/130; 49/127; 49/214; 49/410

[58] Field of Search ..... 49/127, 128, 130, 213, 49/214, 215, 410, 411

[56] References Cited

U.S. PATENT DOCUMENTS

| | | | |
|---|---|---|---|
| 1,712,562 | 5/1929 | Jeffers | 49/214 |
| 1,889,112 | 11/1932 | Shoemaker | 49/409 |
| 1,934,299 | 11/1933 | Fairhurst | 49/127 |
| 2,944,282 | 7/1960 | Greco | 49/127 X |
| 3,587,477 | 6/1971 | Ferris | 49/410 X |
| 4,073,092 | 2/1978 | Williams | 49/127 |
| 4,152,872 | 5/1979 | Tanizaki et al. | 49/214 |
| 4,384,429 | 5/1983 | Rokicki et al. | 49/130 |
| 4,428,304 | 1/1984 | Moser | 49/127 X |
| 4,464,863 | 8/1984 | Chikaraishi et al. | 49/213 |
| 4,565,031 | 1/1986 | Sakamoto | 49/127 X |
| 4,566,667 | 1/1986 | von resch | 49/130 X |
| 4,651,469 | 3/1987 | Ngian et al. | 49/411 X |
| 4,697,384 | 10/1987 | Tutikawa | 49/127 X |
| 4,752,106 | 6/1988 | Salvarani | 49/130 X |
| 4,924,930 | 5/1990 | Drennan | 49/130 X |
| 4,949,504 | 8/1990 | Bortoluzzi | 49/130 |

FOREIGN PATENT DOCUMENTS

| | | | |
|---|---|---|---|
| 2521254 | 11/1976 | Fed. Rep. of Germany | 49/127 |
| 387606 | 2/1933 | United Kingdom | 49/127 |
| 466466 | 5/1937 | United Kingdom | 49/130 |
| 2041052 | 9/1980 | United Kingdom | 49/127 |

*Primary Examiner*—Renee S. Luebke
*Assistant Examiner*—Jerry Redman
*Attorney, Agent, or Firm*—Darby & Darby

[57] ABSTRACT

A single sliding sash in which a sliding door, which is positioned on the internal side of a fixed section when open and which closes an open section when closed, is fixed to a window frame. This window frame has the fixed section on one side thereof and the open section on the other side. Upper guide rails are provided on a head. The sliding door is supported, with the aid of sliding door support pieces, by a pair of sash pulleys, which travel along the upper guide rails so as to change the position of the sliding door in the direction of the shash pulleys. A bend space is provided close to a door front edge hard frame of the upper guide rails. One end of the bend space communicates with a guide space which is provided between the guide rails, whereas the other end of the bend space is arranged on the external side of the guide space. The front edge side of the sliding door is supported, with the aid of arm pieces, by an upper guide member, which travels through these spaces so as to change the position of the sliding door in the direction of the upper guide member.

6 Claims, 18 Drawing Sheets

SINGLE SLIDING SASH

This is a continuation, of application Ser. No. 589,774, filed Sep. 28, 1990, now abandoned.

BACKGROUND OF THE INVENTION

1. Field of the Invention

The present invention relates to a single sliding sash in which a sliding door which is positioned on the internal side of a fixed section when open and which closes an open section when closed is fixed to a window frame which has the fixed section on one side thereof and the open section on the other side.

2. Description of the Related Art

While it is needless to cite well-known examples, conventional single sliding sashes are constructed in such a manner that when open sections of window frames are closed by sliding doors, the sliding doors are positioned outside fixed sections. The outward appearance of such a conventional single sliding sash is similar to that of the so-called horizontally sliding sash.

According to conventional examples, since the sliding door is arranged close to the fixed section on the internal side when the door is closed, the outward appearance of such a sash is not good as compared with the so-called fixed sash. The outward appearance of an entire building is spoiled, especially when a fixed sash as well as a single sliding sash are fixed to the building, because the outward appearances of both the types of sashes differ from each other.

SUMMARY OF THE INVENTION

An object of the present invention is to provide a single sliding sash whose outward appearance is similar to that of a fixed sash when the door is closed.

In order to achieve this object, a sliding door, supported by sash pulleys which travel along guide rails, travels in the direction of an open section. A guide member, provided on the front edge of the sliding door, travels through a guide space, and further into a bend space, thereby shifting from the internal side of a fixed section to the external side of the fixed section. At this time, when the sliding door is pressed in the direction of the sash pulleys and an upper guide member, the position of the sliding door changes from the opening position to the external direction. As a result, the sliding door is positioned flush with the fixed section. The sliding door is supported not only by the sash pulleys with the aid of sliding door support pieces, but also by the upper guide member with the aid of arm pieces. An object of the present invention is to provide a novel single sliding sash.

DESCRIPTION OF THE PREFERRED EMBODIMENT

Figure 1:
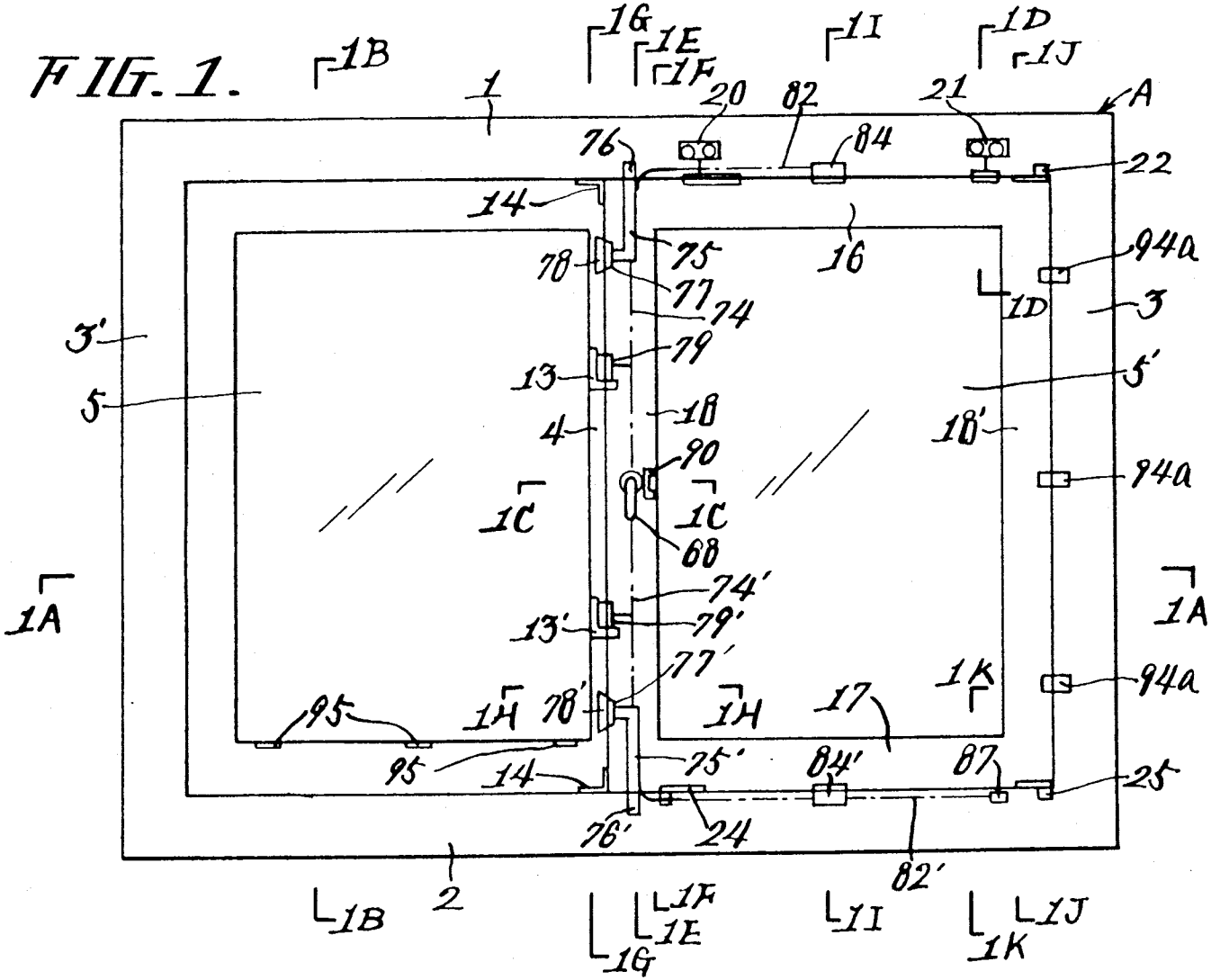
FIG. 1 is a schematic illustration showing the state where various sections of a single sliding sash according to the present invention are arranged.
Figure 2:
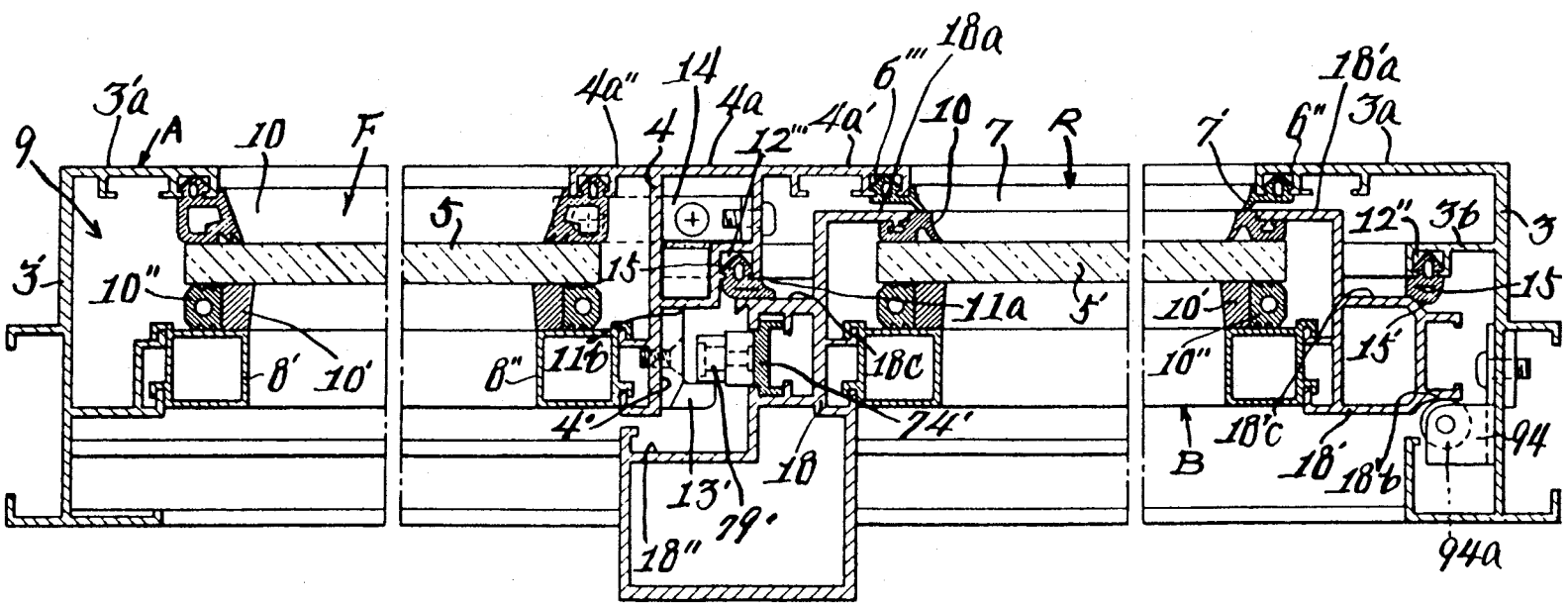
FIG. 2 is a cross-section view taken along line 1A—1A of FIG. 1.
Figure 3:
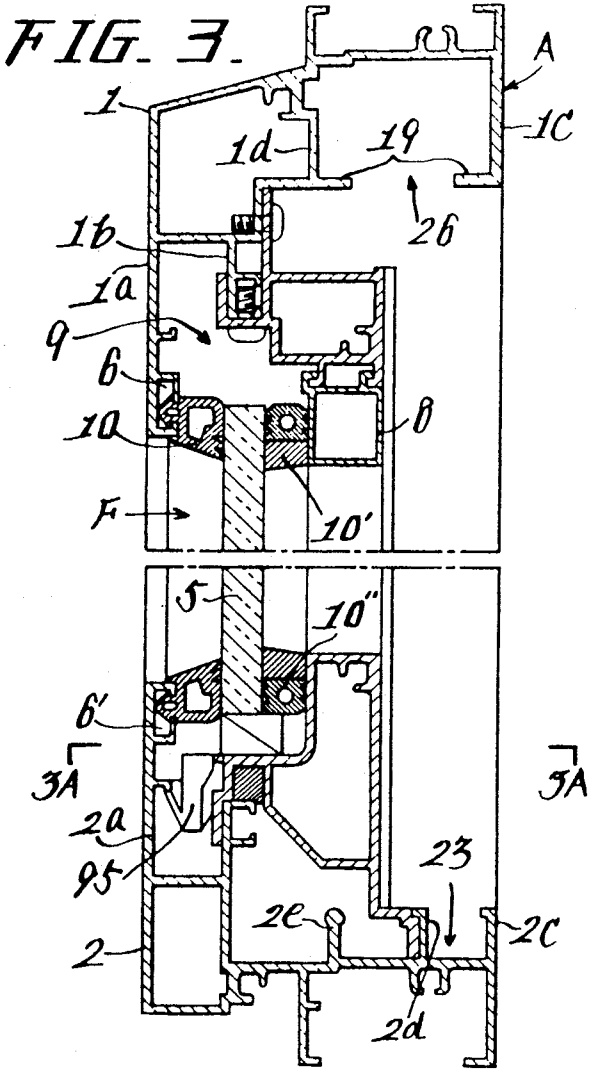
FIG. 3 is a cross-sectional view taken along line 1B—1B of FIG. 1.

As illustrated in the drawings, a single sliding sash of the present invention has a construction in which a sliding door B is attached to a window frame A having a fixed section F on one side of the frame A. (Refer to FIG. 1, which shows the state where various components of the single sliding sash are arranged, so that it is easy to understand the sash by contrasting FIG. 1 with the other drawings.) As shown in FIGS. 2 and 3, the window frame A is constructed in the following manner. A head 1, a sill 2, a door front edge hard frame 3 (illustrated on the right side of FIG. 2; hereinafter referred to simply as a door edge hard frame 3), a door rear edge hard frame 3' (illustrated on the left side of FIG. 2; hereinafter referred to simply as a door edge hard frame 3'), and a mullion 4 are fixed together. A glass panel 5 is then fitted into a space composed of the head 1, the sill 2, the door edge hard frame 3' in order to provide the fixed section F. An open section R which is opened and closed by the sliding door B is provided adjacent to the fixed section F.

The open section R of the window frame A is composed of an exterior piece **1*a* of the head 1, an exterior piece 2*a* of the sill 2, an exterior piece 3*a* of the door edge hard frame 3, and one side 4*a'* of an exterior piece 4*a* of the mullion 4. First attachment grooves 6, 6', 6'', 6''' are provided on the ends of all the exterior pieces 1*a*, 2*a*, 3*a*, 4*a*. That is, the grooves are provided on the side face of an internal piece of the open section R. A first air- and water-tight material 7 is attached to the first attachment grooves so as to cover the open section R mentioned above. The end 7' of the first air- and water-tight material 7 is directed in the internal direction so as to protrude from the first attachment grooves 6, 6', 6'', 6''' (see FIGS. 2 and 19**).

As illustrated in FIGS. 2 and 3, the fixed section F is constructed in the following way. The glass panel 5 is engaged with the exterior piece 1*a* of the head, and the exterior piece 2*a* of the sill 2. The glass panel 5 is also engaged with an exterior piece 3'*a* of the door edge hard frame 3', and the other side 4*a''* of the exterior piece 4*a* of the mullion 4. The glass panel 5 is also engaged with an engaging groove 9 which is composed of battens 8, 8', 8''. The battens 8, 8', 8'' are attached to all of the head 1, the door edge hard frame 3', and the mullion 4. The glass panel 5 is then clamped by a dry air- and water-tight material 10 arranged on the external side, a wet air- and water-tight material 10', and by a relatively hard spacer material 10''. Both of the materials 10' and 10'' are arranged on the internal side. This hard spacer material 10 serves as a backup material for the wet air- and water-tight material 10'.

Also, as shown in FIG. 2, a cross-sectional first step 11*a* as well as a cross-sectional second step 11*b* are provided on the side of the open section R of the mullion 4 so as to gradually draw toward the side of the fixed section F mentioned above. A second attachment groove 12''' is provided on the first stage 11*a*. The second attachment groove 12''' communicates with second attachment grooves 12, 12', 12'' which are all provided on the first stage of the head 1, which will be described later. A pair of vertical L-shaped intermediate drawing pieces 13, 13' are fixed to the inner face 4' of the mullion 4, which is positioned between the second step 11*b* and the internal edge of the mullion 4.

Figure 17:
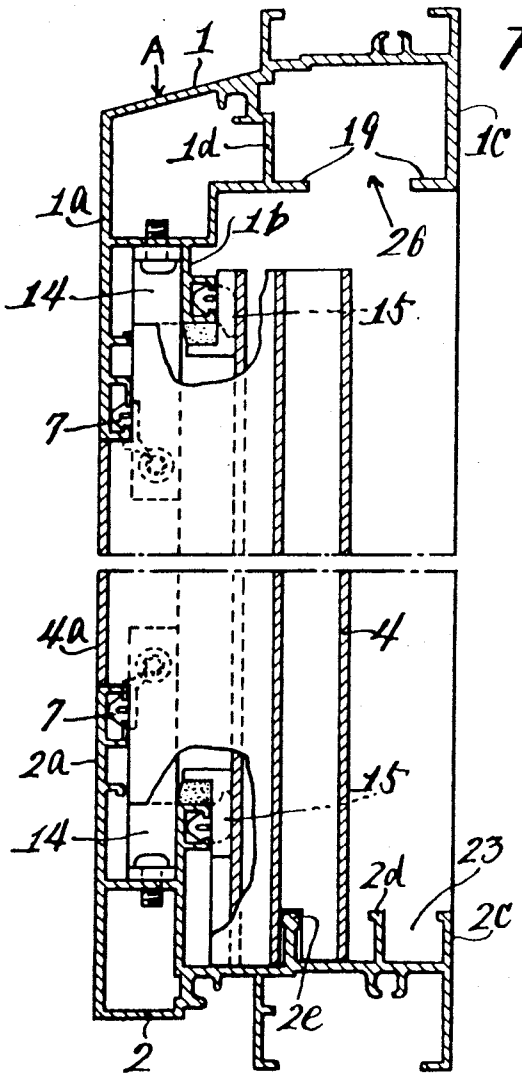
FIG. 17 is a cross-sectional view taken along line 1G—1G of FIG. 1.

As shown in FIGS. 2 and 17, the mullion 4 is fixed, with the aid of L-shaped attaching pieces 14, to the head 1 and the sill 2.

Moreover, as illustrated in FIGS. 2 and 3, receiving pieces 1*b*, 2*b*, 3*b*, are attached to the sides of the exterior pieces 1*a*, 2*a*, 3*a*. The ends of the receiving pieces 1*b*, 2*b*, 3*b* are positioned outside the exterior pieces 1*a*, 2*a*, 3*a* of the head 1, sill 2, and the door edge hard frame 3, respectively. That is, the pieces are positioned on the outside of the window frame A. The second attachment grooves 12, 12', 12'' are provided on the internal side of the receiving pieces 1*b*, 2*b*, and 3*b*. The second attachment grooves 12, 12', 12'' communicate with the second attachment groove 12''', which is provided on the first step 11*a* of the mullion 4. Second air- and water-tight materials 15 are provided to the second attachment grooves 12, 12', 12'', 12''' so that the ends 15' thereof protrude in the internal direction.

Figure 19:
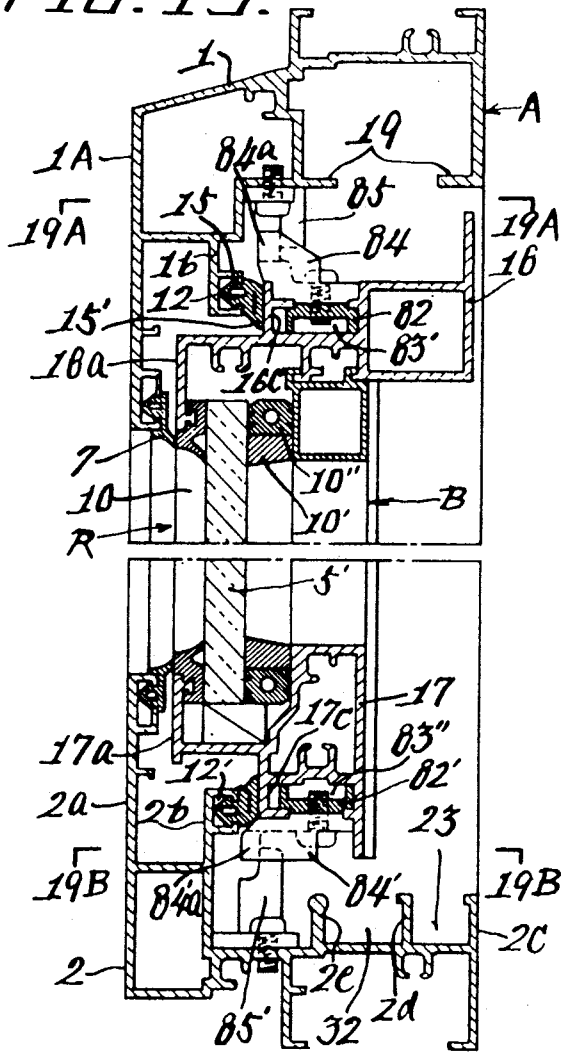
FIG. 19 is a cross-sectional view taken along line 1I—1I of FIG. 1.

The above-mentioned sliding door B is constructed by fixing together an upper rail 16, a lower rail 17, meeting stiles 18, a hard rail 18', and a glass panel 5' (see FIGS. 2 and 19). In the same manner as with the glass panel 5 of the fixed section F, the glass panel 5' is clamped by the dry air- and water-tight material 10 arranged on the external side, the wet air- and water-tight material 10' arranged on the internal side, and by the relatively hard spacer material 10''. This spacer material 10'' serves as a backup material for the wet air- and water-tight material 10'.

As shown in FIGS. 2 and 19, when the sliding door is being closed, all of the ends of the exterior pieces 16*a*, 17*a*, 18*a*, 18'*a* of all the rails 16, 17, 18, 18' are arranged so that the ends do not protrude in the direction of the open section R from the exterior pieces and one side 4*a'* of the exterior piece 4*a* of the mullion 4. These exterior pieces are 1*a* of the head 1, 2*a* of the sill 2, and 3*a* of the door edge hard frame 3. When the sliding door is being closed, the meeting stiles 18 is constructed so as to be stored in the mullion 4; that is, within the width of the exterior piece 4*a*.

The sliding door B is constructed in the following manner. A sash pulley 20 on the side of a meeting style which travels along upper guide rails 19 on the head 1, a sash pulley 21 on the front edge of the door, and an upper guide member 22, are attached to the upper rail 16. A lower guide member 24 on the side of the meeting style which travels along lower guide rails 23 on the sill 2, and a lower guide member 25 on the front edge of the door are attached to the above-mentioned lower rail 17. When the sliding door B is being opened, it is constructed so as to be overlapped by the fixed section F as a result of the travel of the sash pulleys 20, 21, and the guide members 22, 24, 25. When the sliding door B is being closed, it is constructed so as to close the open section R, and is positioned parallel to and flush with the fixed section F.

Figure 14:
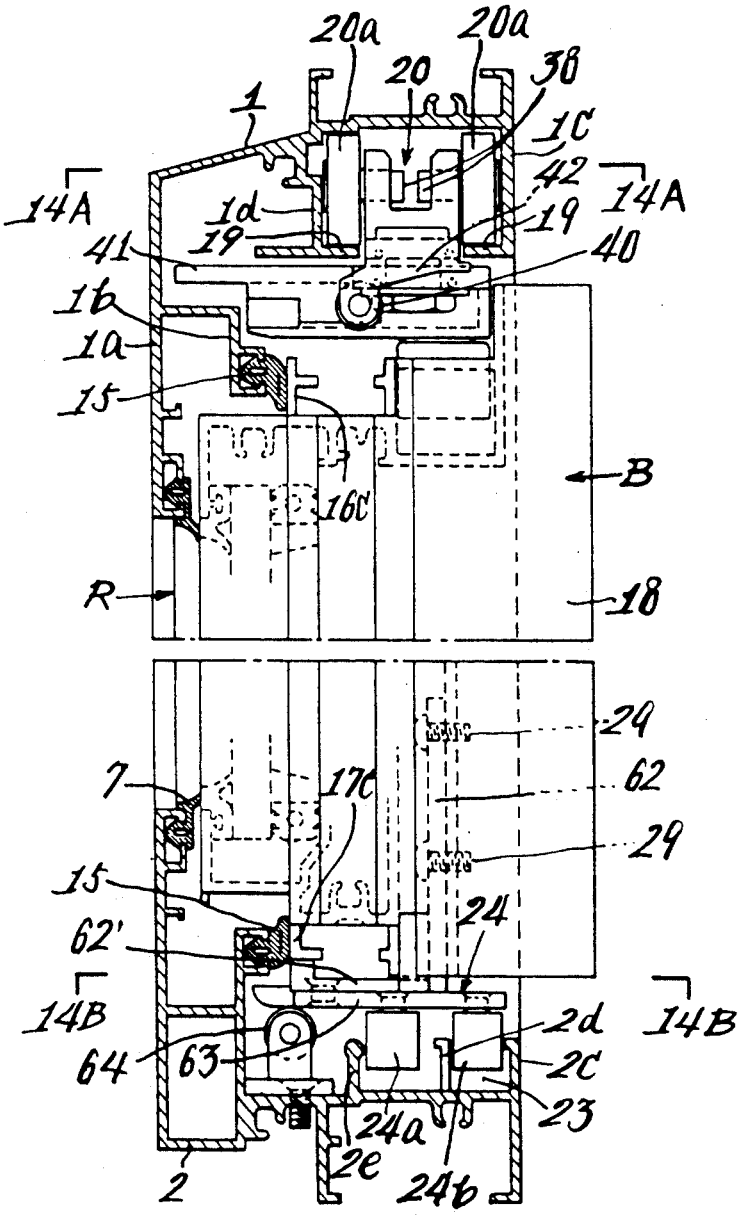
FIG. 14 is a cross-sectional view taken along line 1F—1F of FIG. 1.
Figure 22:
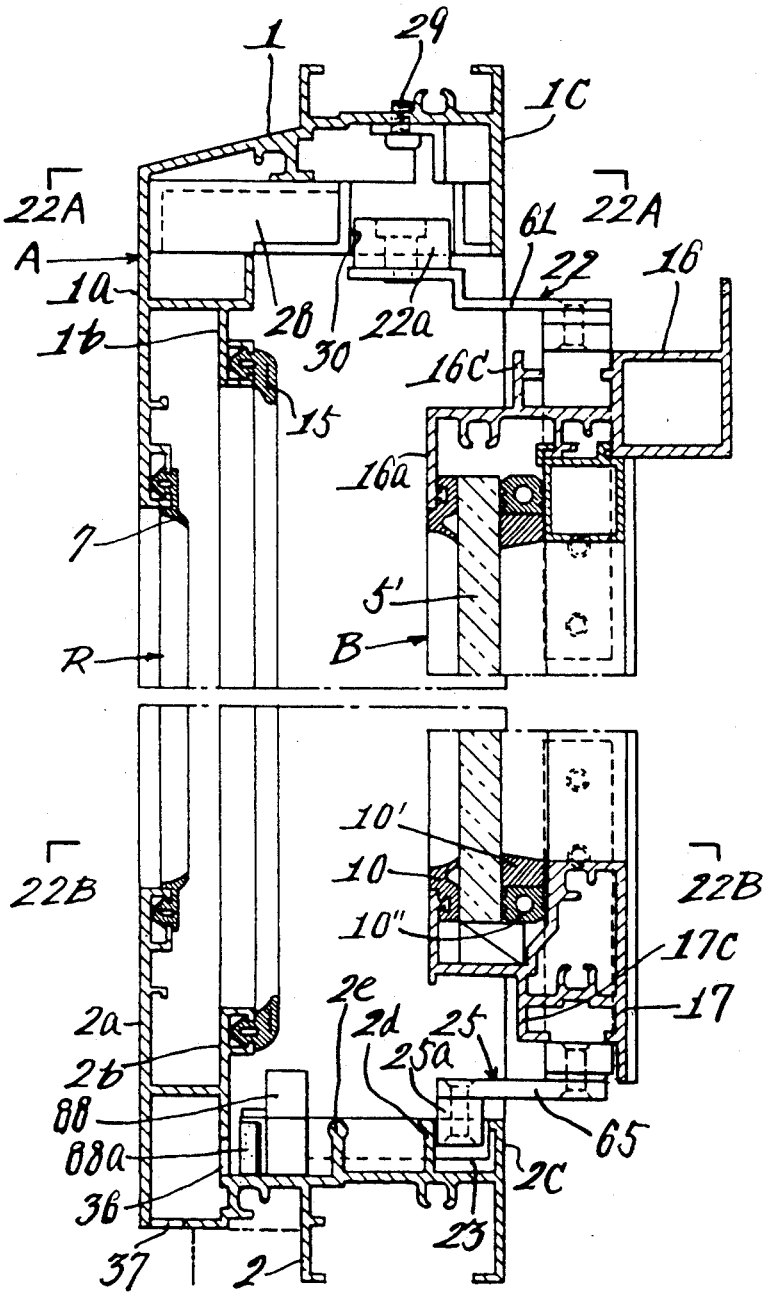
FIG. 22 is a cross-sectional view taken along line 1J—1J of FIG. 1.
Figure 23:
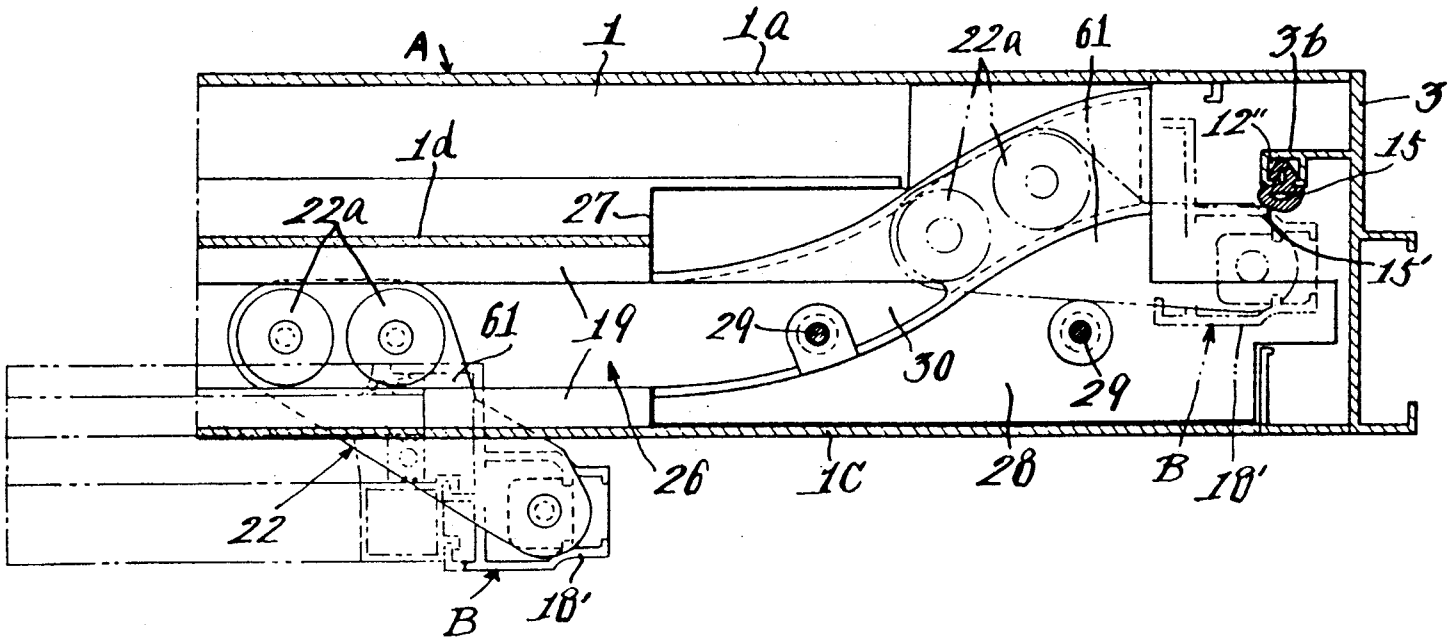
FIG. 23 is a cross-sectional view taken along line 22A—22A of FIG. 22.

As illustrated for instance in FIG. 3, 14 or 23, the upper guide rails 19 mentioned above are made of horizontal pieces which are formed by bending the lower ends of the exterior piece 1*c* of the head 1 and of an intermediate piece 1*d* arranged between the exterior piece 1*c* and the receiving piece 1*d* so as to be opposite one another. The end of the intermediate piece 1*d* forming these upper guide rails 19, and the end of the horizontal piece of the exterior piece 1*c* on the side of the door edge hard frame 3, are cut away 27. An upper auxiliary block 28 is fitted into the cut-away section 27, and is fastened to the head 1 mentioned above by means of screws 29 (see FIGS. 22 and 23). One end of a bend space 30, which is provided on the upper auxiliary block 28, corresponds to a guide space 26 formed by the upper guide rails 19, whereas the other end of the bend space 30 is arranged adjacent to the exterior piece 1*a* of the head 1.

In other words, the upper guide rails 19 are arranged parallel to the above-mentioned fixed section F on the internal. The guide space 26 between the upper guide rails 19 communicates with the bend space 30 formed by the upper auxiliary block 28. The above-described sash pulleys 20, 21 travel along the upper guide rails 19. On the other hand, the upper guide member 22 is engaged with the guide space 26 and the bend space 30 so as to travel along these spaces 26, 30.

Figure 24:
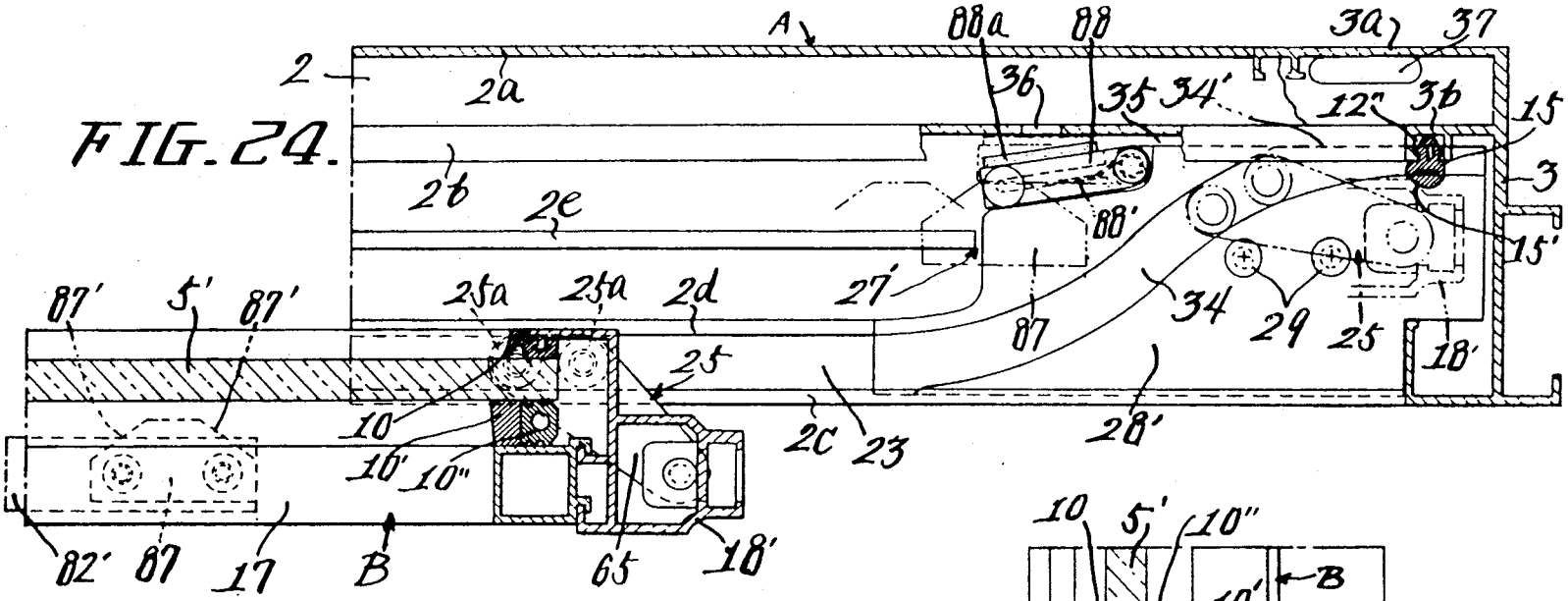
FIG. 24 is a cross-sectional view taken along line 22B—22B of FIG. 22.

As illustrated for example in FIGS. 14, 16, 22 and 24, the lower guide rails 23 are composed of an interior piece 2*c* of the sill 2, and a first intermediate piece 2*d* adjacent to the interior piece 2*c*. In the same manner as with the upper guide rails 19, the lower guide rails 23 are arranged parallel to the fixed section F on the internal side. A doorway cut-away section 33 is provided at the center of the first intermediate piece 2*d* which forms the lower guide rails 23, that is, in the part where the mullion 4 and the meeting stiles 18 are overlapped. A groove 32 along which travels a first roller 24*a* of the lower guide member 24 on the side of the meeting style, is provided in the doorway cut-away section 33. The groove 32 is composed of the first intermediate piece 2*d* of the sill 2, and a second intermediate piece 2*e* disposed outside the first intermediate piece 2*d* (see FIGS. 14 and 16). Furthermore, as shown in FIG. 24, the ends of the first and second intermediate pieces 2*d*, 2*e* on the side of the above-mentioned door edge hard frame 3 are cut away 27'. A lower auxiliary block 28' is fitted to the cut-away section 27' so that it is positioned directly under the upper auxiliary block 28. The lower auxiliary block 28' is then fastened to the sill 2 by means of the screws 29. One end of a bend rail 34, which is provided on the lower auxiliary block 28', corresponds to the above-mentioned lower guide rail 23. An open end 34' on the other end of the bend rail 34 is positioned adjacent to the receiving piece 2*b* of the sill 2 arranged outside the second intermediate piece 2*e* mentioned above. The open end 34' communicates, through the space 35 between the lower auxiliary block 28' and the receiving piece 2*b*, with a drainage hole 36 which is provided on the receiving piece 2*b*.

On the one hand, the lower guide member 24 on the side of the meeting style, and the lower guide member 25 on the front edge of the door are arranged so as to travel along the lower guide rails 23. On the other hand, the lower guide member 25 on the front edge of the door is arranged so as to travel along the bend rails 34 which communicate with the lower guide rails 23.

The drainage hole 36 communicates with the outside via a drain opening 37 which is disposed on the lower end of the external side of the sill 2.

Figure 15:
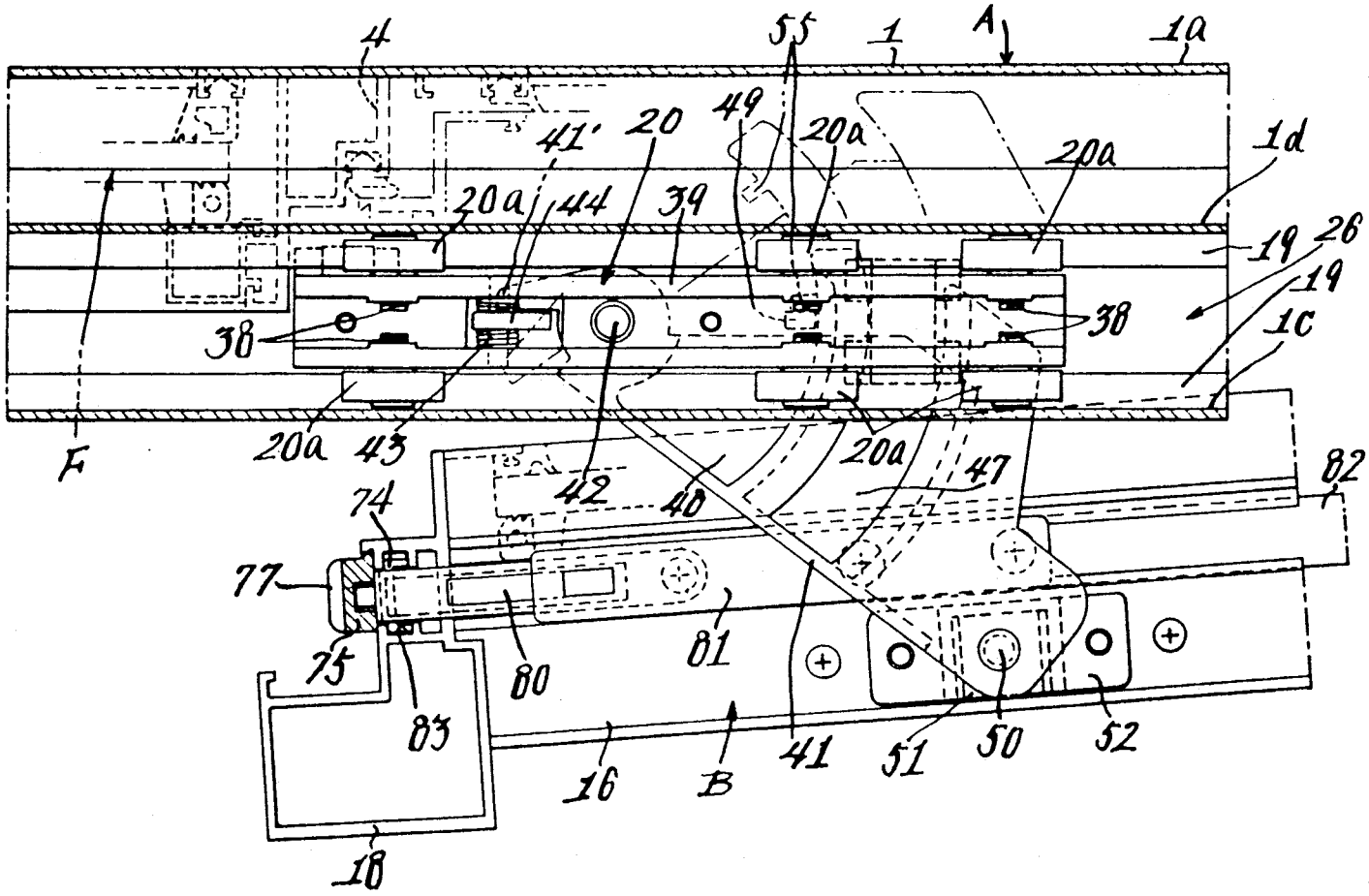
FIG. 15 is a cross-sectional view taken along line 14A—14A of FIG. 14.

The sash pulley 20 (see FIGS. 11, 12 and 15) on the side of the meeting style is constructed in the following manner. It is rotatably fixed to one end of a main frame 39 on the side of the meeting stiles 18, to which an upward drawing roller 40, which also serves as a lock, is rotatably fixed. Wheels 20*a*, which roll along the upper guide rails 19, are rotatably fixed by axles 38 to the main frame 39. The base end side of a sliding door support piece 41 is rotatably fixed by a support shaft 42 to the intermediate section of the main frame 39. A coiled spring 43 is additionally provided between the support shaft 42 and the upward drawing roller 40 mentioned above. A first stopper 44, energized in a rising direction, is fixed so as to rise and fall. Also, a support piece 45 is arranged on one end of the main frame 39 on the front edge of the door so as to be suspended through the guide space 26 mentioned above. A roller 46 is rotatably fixed to the support piece 45, and is engaged with a first arc-like groove 47 which is arranged in the intermediate section of the sliding door support piece 41. A second stopper 49, suspended from the main frame 39 between the support piece 45 and the support shaft 42, is engaged with a second arc-like groove 48 which is provided adjacent to the first arc-like groove 47 on the side of the support shaft 42.

A hinge pin 50 is suspended from the end of the sliding door support piece 41, and a square tube-like intermediate frame 51 is loosely fitted to the hinge pin 50. The intermediate frame 51 is attached so as to vertically move to a connection block 52 fixed to the upper rail 16 of the sliding door B. In the connection block 52, the tip of an adjusting screw 53, penetrating from the under face of the upper rail 16, is helically mated with the intermediate frame 51.

That is, the side of the meeting stiles 18 of the sliding door B is supported, with the aid of the slide door support piece 41, by the sash pulley 20 on the meeting stiles.

When the sliding door is being closed, the upper end 44' of the first stopper 44 is brought into contact with the center of the upper rail 1. In other words, the upper end 44' is brought into contact with a projected edge 54 which is provided directly over the guide space 26. As a result, the first stopper 44 falls against the force acting on the coiled spring 43. When the sliding door is being opened, the first stopper 44 rises because of the energy from the coiled spring 43. The lower end 44" of the first stopper 44 is then brought into contact with the internal end face of a base 41' of the above-described sliding door support piece 41, thereby regulating the rotation in one direction in which the support shaft 42 of the sliding door support piece 41 serves as a fulcrum. When the sliding door is being opened, the rotation of the first stopper 44 in the other direction is regulated by virtue of the fact that the second stopper 49 is stopped by a projected strip 55, which is vertically arranged on the exterior end of a side wall of the second arc-like groove 48.

The space between the upper rail 16 of the sliding door and the head 1 can be adjusted by operating the adjusting screw 53 mentioned above. Numeral 56 in FIG. 11 denotes a cover plate.

Figure 9:
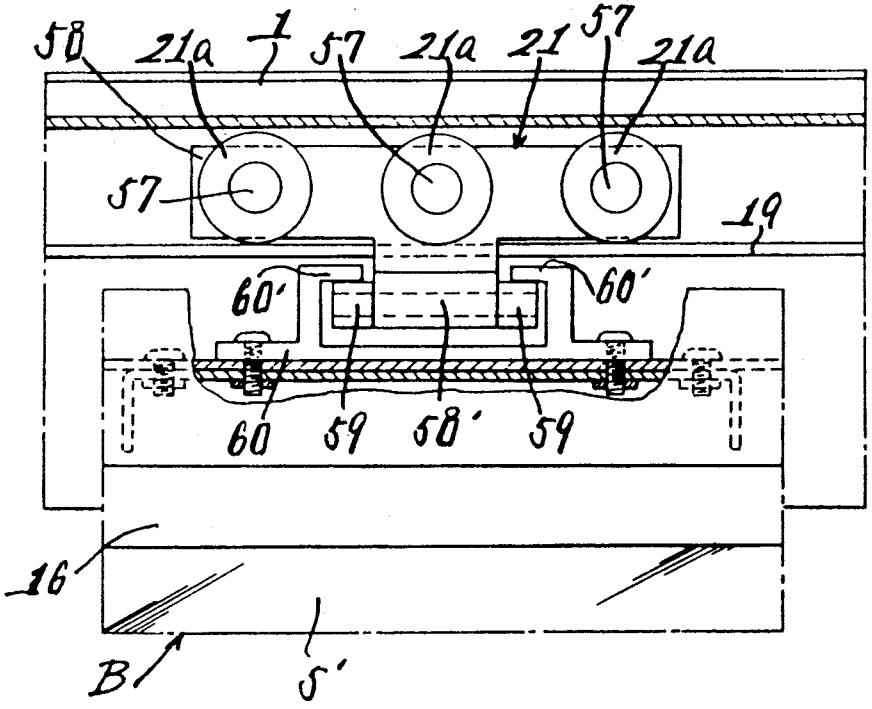
FIG. 9 is a cross-sectional view taken along line 8A—8A of FIG. 8.
Figure 8:
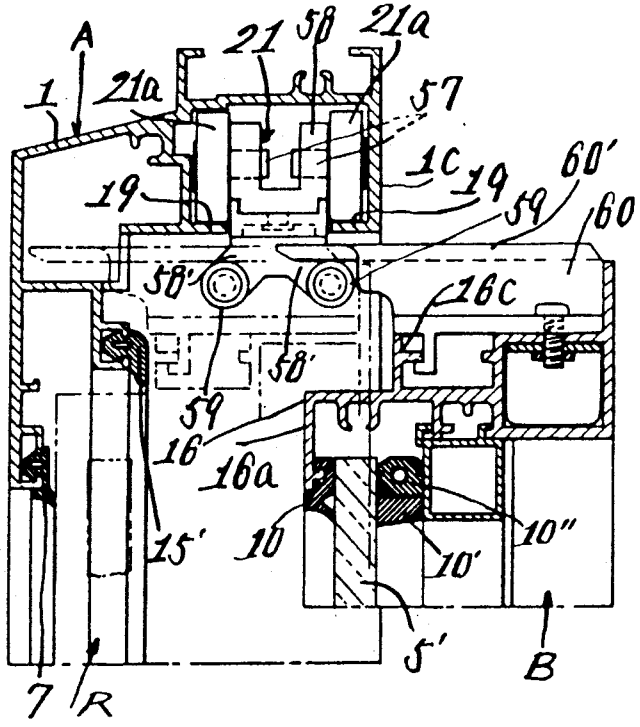
FIG. 8 is a cross-sectional view taken along line 1D—1D of FIG. 1.

The sash pulley 21 on the front edge of the door is constructed in the following way. It is disposed on the side of the guide member 22 between the sash pulley 20 on the side of the meeting style and the upper guide member 22. As illustrated in FIGS. 8 and 9, branch pieces 58' are suspended from a main frame 58, to which wheels 21*a*, traveling along the upper guide rails 19, are rotatably fixed by axles 57. Support rollers 59 are rotatably fixed to the branch pieces 58', respectively, in both the internal and external directions. A sliding door support frame 60 is arranged so as to protrude from the upper face of the upper rail 16 of the sliding door B. A pair of projected support pieces 60', opposite to the sliding door support frame 60, are vertically disposed in the external direction. The support rollers 59 are supported so as to travel in both the internal and external directions. That is, the side of the door front edge of the sliding door B is supported, with the aid of the sliding door support frame 60, by the sash pulley 21 on the front edge of the door. Thus, the position of the sliding door B can change in the internal as well as external directions.

As shown in FIG. 23, the upper guide member 22 is constructed in such a manner that a roller 22*a* is rotatably fixed to the end of an arm piece 61, whose base is rotatably attached to the front of the sliding door B. The upper section on the front side of the sliding door B travels along the above-described guide space 26 and the bend space 30. The upper section on the front side of the sliding door B travels between the hard frames 3, 3' while it is regulated by the roller 22*a* of the upper guide member 22.

Figure 16:
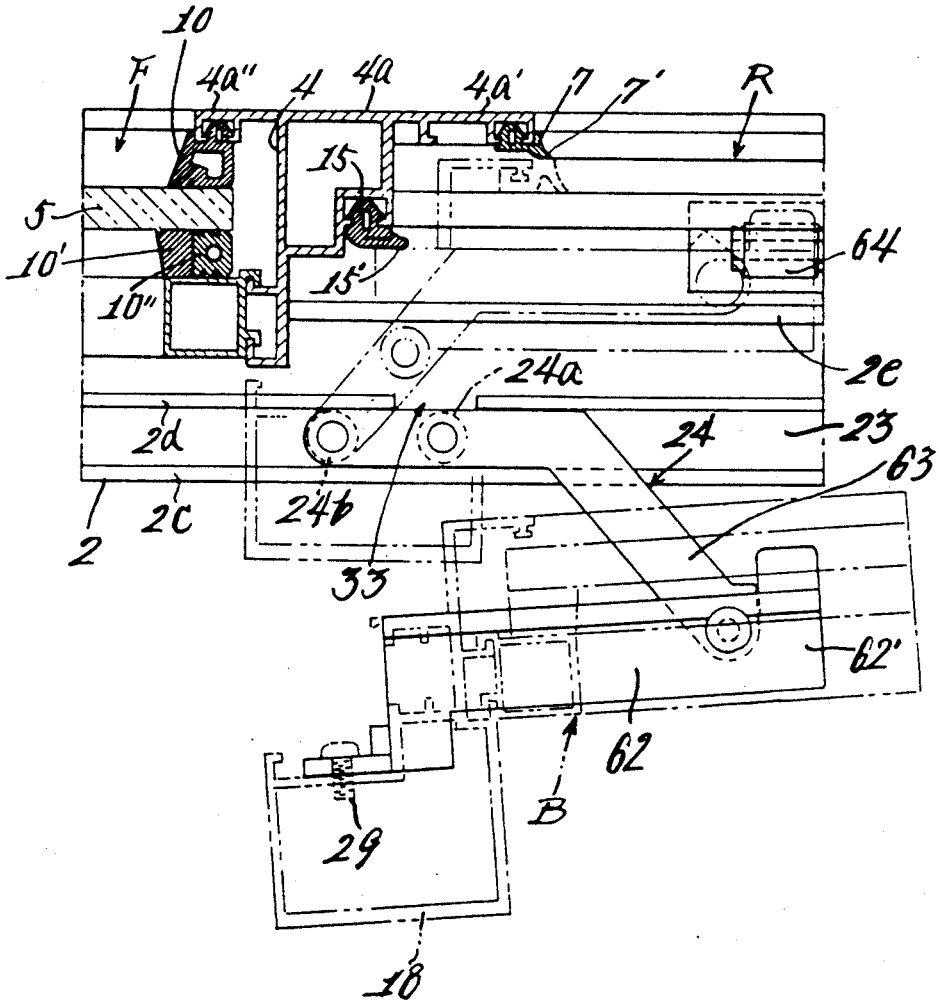
FIG. 16 is a cross-sectional view taken along line 14B—14B of FIG. 14.

As shown in FIGS. 14 and 16, the lower guide member 24 on the side of the meeting style is constructed in the following way. The base of an arm piece 63, which is bent at the center, is rotatably fixed to a horizontal piece 62' of an attachment piece 62. The attachment piece 62 is attached to the meeting stiles 18 by means of the screws 29. The above-mentioned first roller 24*a* and a second roller 24*b* are arranged parallel to each other, and are rotatably fixed on the front side of the arm piece 63. Both the rollers 24*a*, 24*b* are engaged with the lower guide rails 23 mentioned above. When the sliding door is being closed, the first roller 24 shifts to the groove 32 with the aid of the doorway cut-away section 33, thereby not hindering the closing operation of the sliding section B in the open section R.

Numeral 64 in the drawings designates a support roller for supporting the horizontal piece 62' of the attachment piece 62. The support roller 64 is rotatably fixed to the sill 2.

The operation of the lower section on the side of the meeting style of the sliding door B is regulated by this lower guide member 24 on the side of the meeting style.

The lower guide member 25 on the front edge of the door is mainly shown in FIG. 24. That is, it is constructed in the same manner as that of the upper guide member 22. On the end of an arm piece 65, whose base is rotatably attached to the front edge of the door, the rotatably fixed roller 25*a* is engaged with the lower guide rails 23. The lower guide member 25 travels along the lower guide rails 23 and the bend rails 34 which communicate with the lower rail 23. Both the lower guide rails 23 and the bend rails 34 are positioned on the lower end of the sliding door B.

Figure 7:
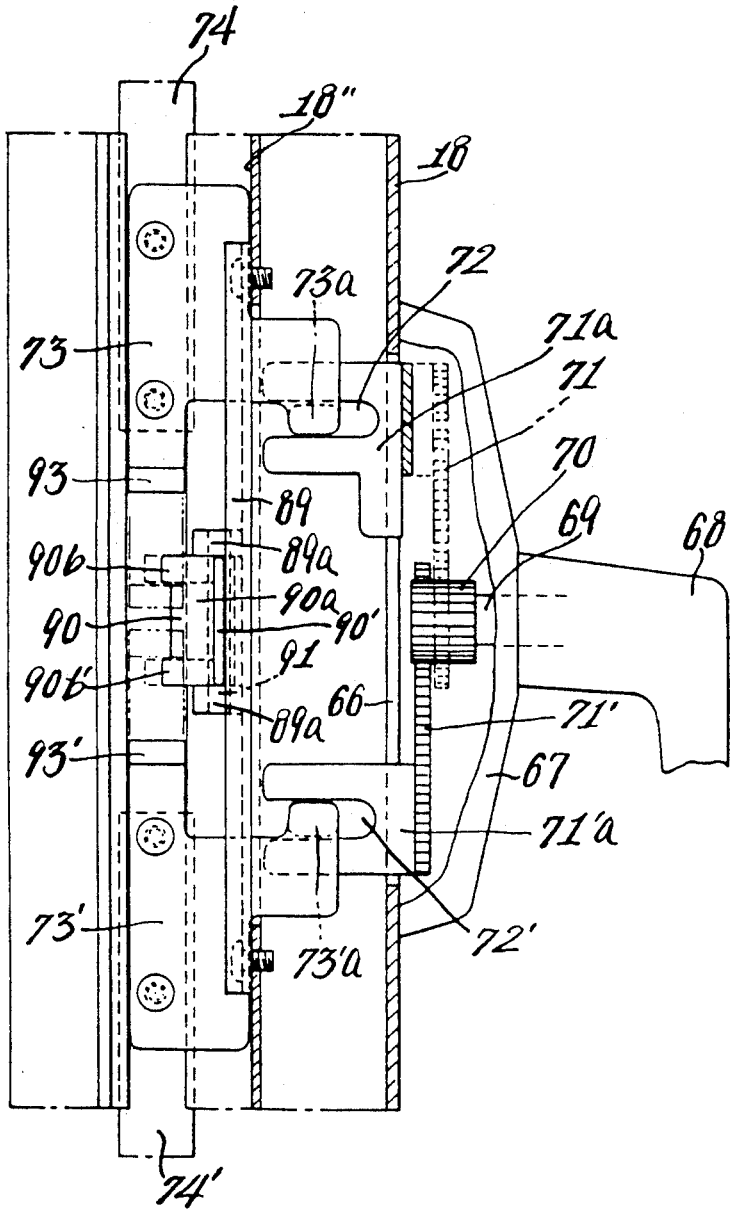
FIG. 7 is a cross-sectional view taken along line 5A—5A of FIG. 5.

Numeral 66 designates a long hole, extending vertically, which is provided at the vertical center of the above-described meeting stiles 18. As described earlier, the meeting stiles 18 are stored within the width of the mullion 4 when the sliding door is closed. A seat frame 67, to which an operation knob 68 is attached, is installed so as to close the long hole 66 (see FIGS. 5 and 7).

Figure 10:
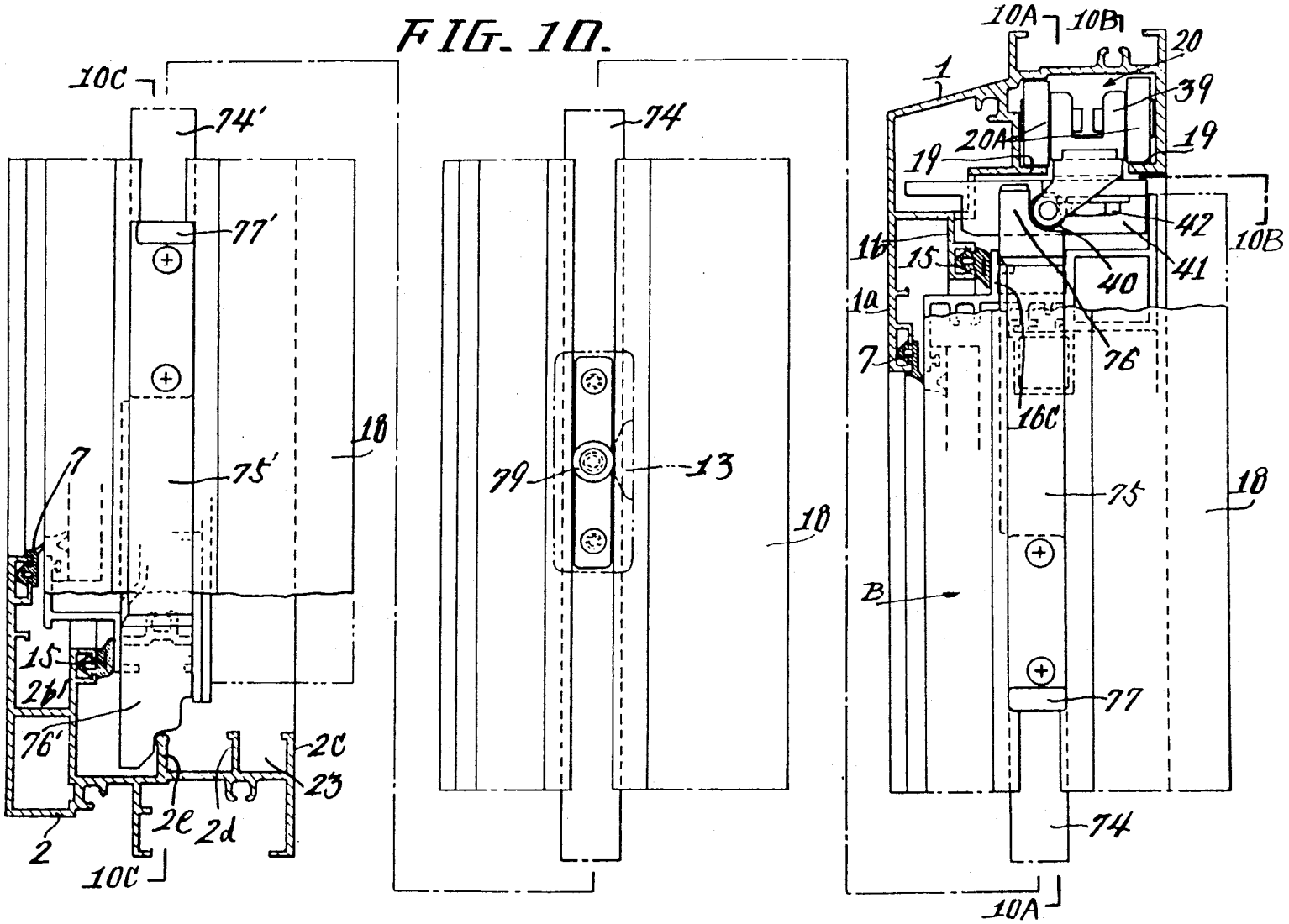
FIG. 10 is a cross-sectional view taken along line 1E—1E of FIG. 1.
Figure 11:
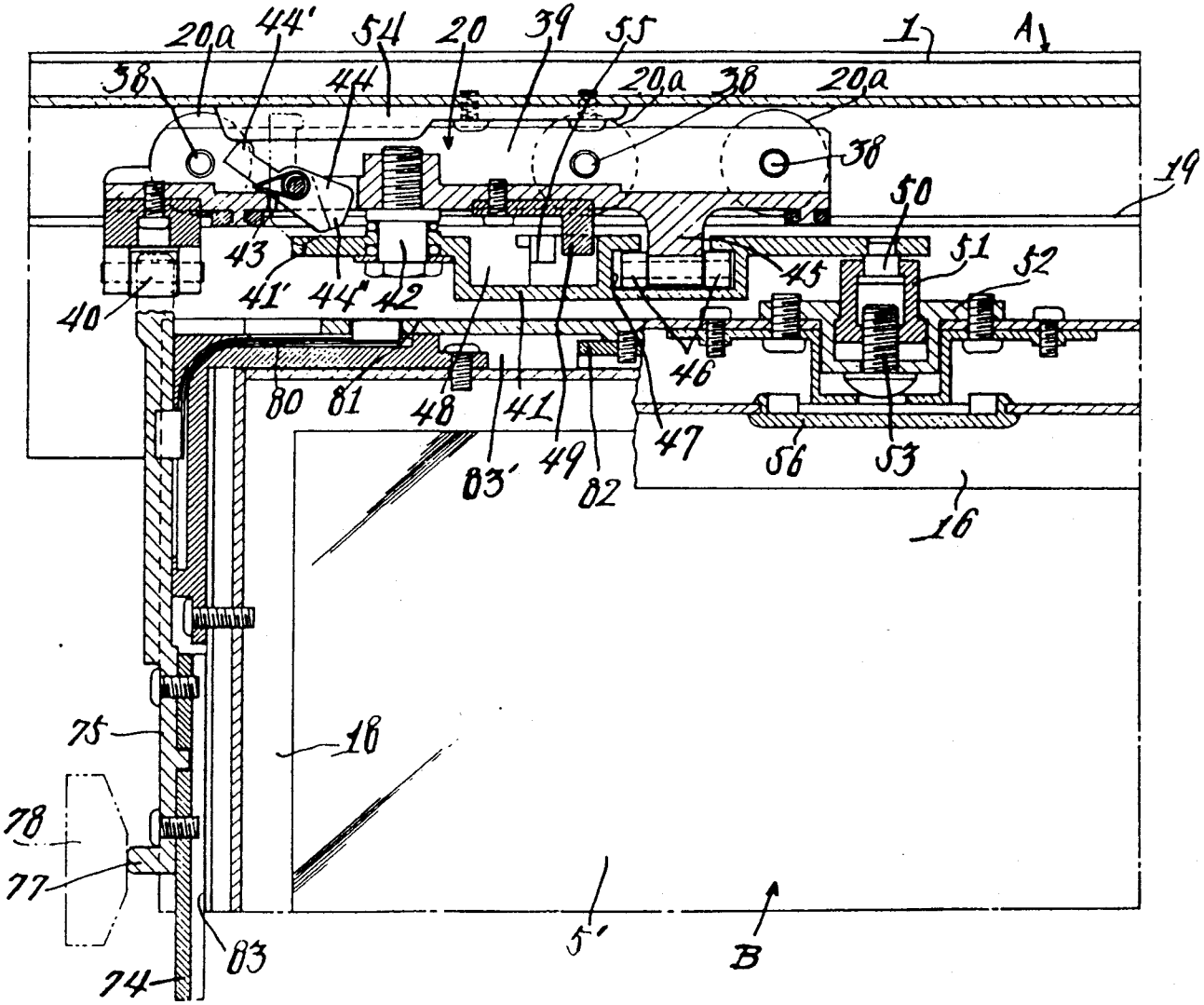
FIG. 11 is a cross-sectional view taken along line 10A—10A of FIG. 10.
Figure 12:
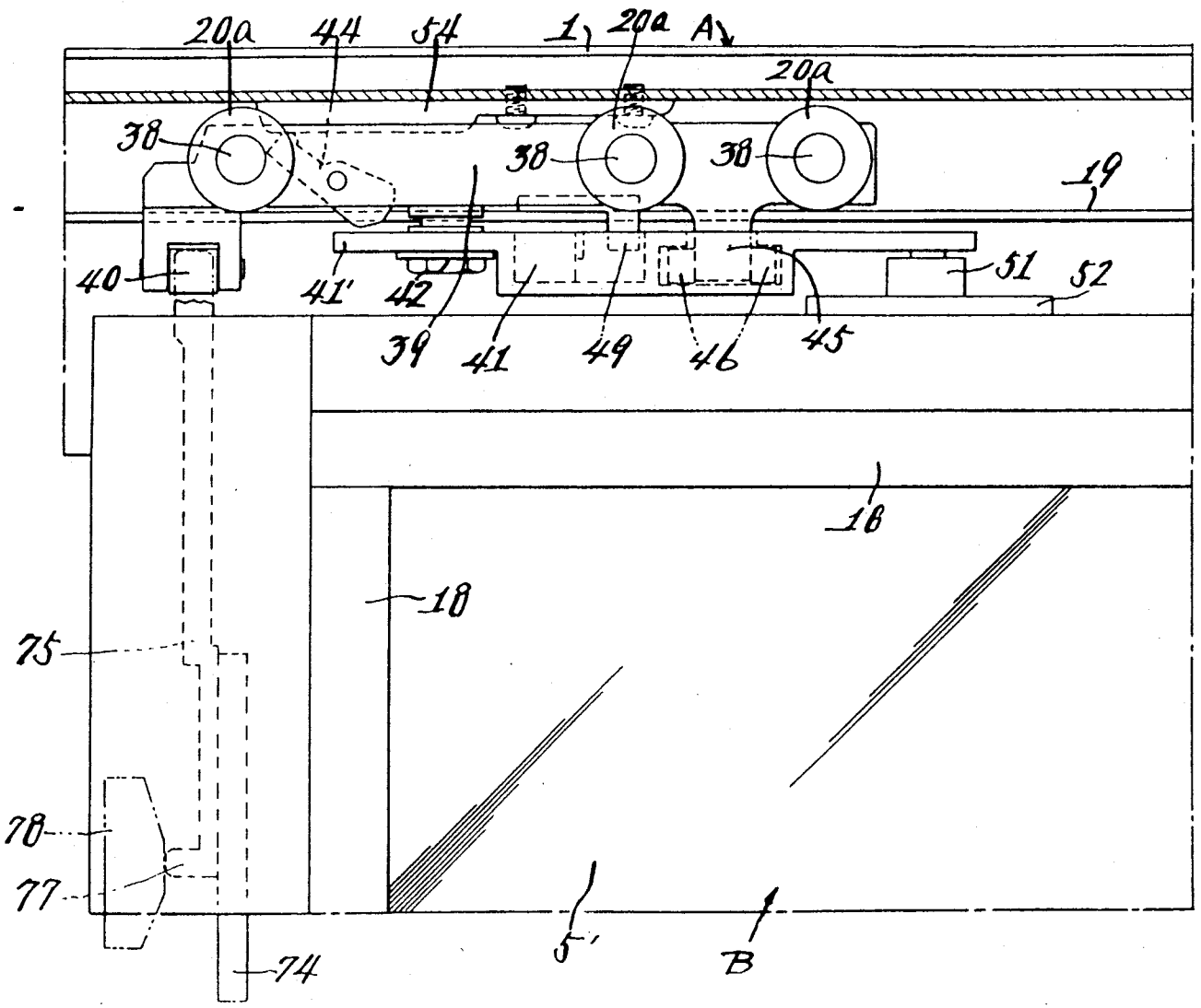
FIG. 12 is a cross-sectional view taken along line 10B—10B of FIG. 10.

A pinion 70 is attached to the end of a rotary shaft 69 of the operation knob 68. The pieces 73*a*, 73'*a* of upper and lower intermediate pieces 73, 73' are engaged with cut-away section 72, 72'. The sections 72, 72' are provided on the bases 71*a*, 71'*a* of upper and lower racks 71, 71', which are engaged with the pinion 70. The upper and lower intermediate pieces 73, 73' are respectively attached to the upper and lower ends of vertically moving frames 74, 74' (see FIG. 7). As illustrated in FIGS. 10 and 11, an upward drawing member 75 is attached to the upper end of the upward moving frame 74. On the contrary, as shown in FIGS. 9 and 11, a downward drawing member 75' is attached to the lower end of the downward moving frame 74'. An upward drawing piece 76, which also acts as a lock, is provided on the upper end of the upward drawing member 75. The upward drawing member 75 is disengaged from the upward drawing roller 40. On the other hand, a downward drawing piece 76', which also acts as a lock, is provided on the lower end of the downward drawing member 75'. The downward drawing member 75' is disengaged from the second intermediate piece 2*e* of the sill 2.

Numeral 77 denotes an upward separating projection which protrudes in the direction of the mullion 4 and is arranged on the lower end of the upward drawing member 75 (see FIGS. 10 and 11). Numeral 77' denotes a downward separating projection which protrudes in the direction of the mullion 4 and is arranged on the upper end of the upward drawing member 75' (see FIGS. 10, 11, 12 and 13). Upper and lower separate receiving pieces 78, 78' are provided on the inner face 4' of the mullion 4. The upper and lower separate receiving pieces 78, 78' come in contact and overlap with each other in the direction between the projections 77, 77' and the hard frame 3, 3', when the sliding door is being closed.

Figure 18:
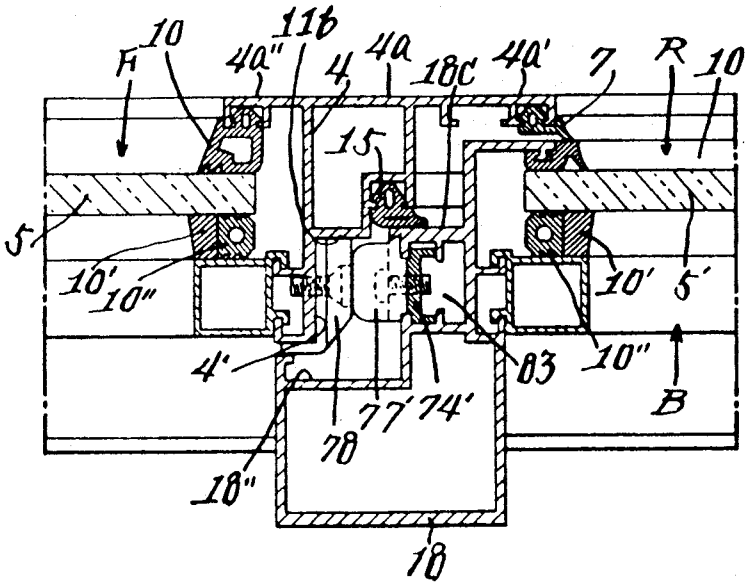
FIG. 18 is a cross-sectional view taken along line 1H—1H of FIG. 1.

Numerals 79, 79' designate upper and lower intermediate drawing rollers which are arranged at the center of each of the upward and downward moving frames 74, 74'. (The lower intermediate drawing roller 79' is shown in FIG. 2.) In the same way as with the upper and lower separate receiving pieces 78, 78', the intermediate drawing pieces 13, 13', which stops the intermediate drawing rollers 79, 79', are provided on the inner face 4' of the mullion 4. The intermediate drawing rollers 79, 79' are constructed so as to be pressed into contact with the intermediate drawing pieces 13, 13'. As described earlier, the second air- and water-tight material 15 is provided on the first step 11*a* of the mullion 4. The second air- and water-tight material 15 is brought into contact with a piece 18*c* of the meeting stiles 18 during the pressure contact (see FIG. 18).

Numeral 80 designates an upper leaf spring. One end of the leaf spring 80 is attached to the upper part of the upward drawing member 75 (see FIG. 11). Numeral 80' designates a lower leaf spring. One end of the lower leaf spring 80' is attached to the lower part of the downward drawing member 75' (see FIG. 13). The other end of the upper leaf spring 80 is attached to the base of an upper connecting piece 81. The base of a horizontally moving upper frame 82 is attached to the end of the upper connecting piece 81.

The horizontally moving upper frame 82 is engaged with a horizontal upper guide groove 83' in which a piece 16*c* of the upper rail 16 which comes in or out of contact with the second air- and water-tight material 15, forms an external wall. This engagement is carried out in the same manner as with the upward moving frame 74; that is in the same manner as when the upward moving frame 74 is engaged with a vertical guide groove 83 provided in the meeting stiles 18 (see FIGS. 11 and 20). The upper intermediate drawing piece 84 is attached to the end of the horizontally moving upper frame 82.

Figure 20:
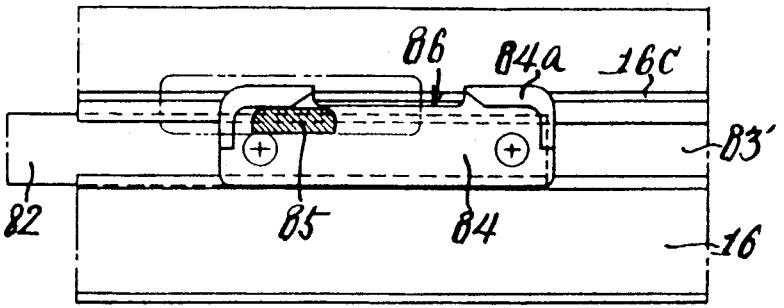
FIG. 20 is a cross-sectional view taken along line 19A—19A of FIG. 19.

As shown in FIGS. 19 and 20, the upper intermediate drawing piece 84 has a rising piece 84*a* on the external side thereof. A doorway cut-away section 86 of a receiving piece 85 for the upper intermediate drawing piece is provided at the center of the rising piece 84*a*.

The receiving piece 85 for the upper intermediate drawing piece is positioned substantially in the middle of the door edge hard frame 3 and the mullion 4 of the head 1, and is disposed so as to be suspended from the head 1 in the vicinity of the head receiving piece 1*b* (see FIG. 19).

Furthermore, the other end of the above-mentioned lower leaf spring 80' is attached to the base of a lower connecting piece 81'. The base of a horizontally moving lower frame 82' is attached to the lower connecting piece 81'.

Figure 13:
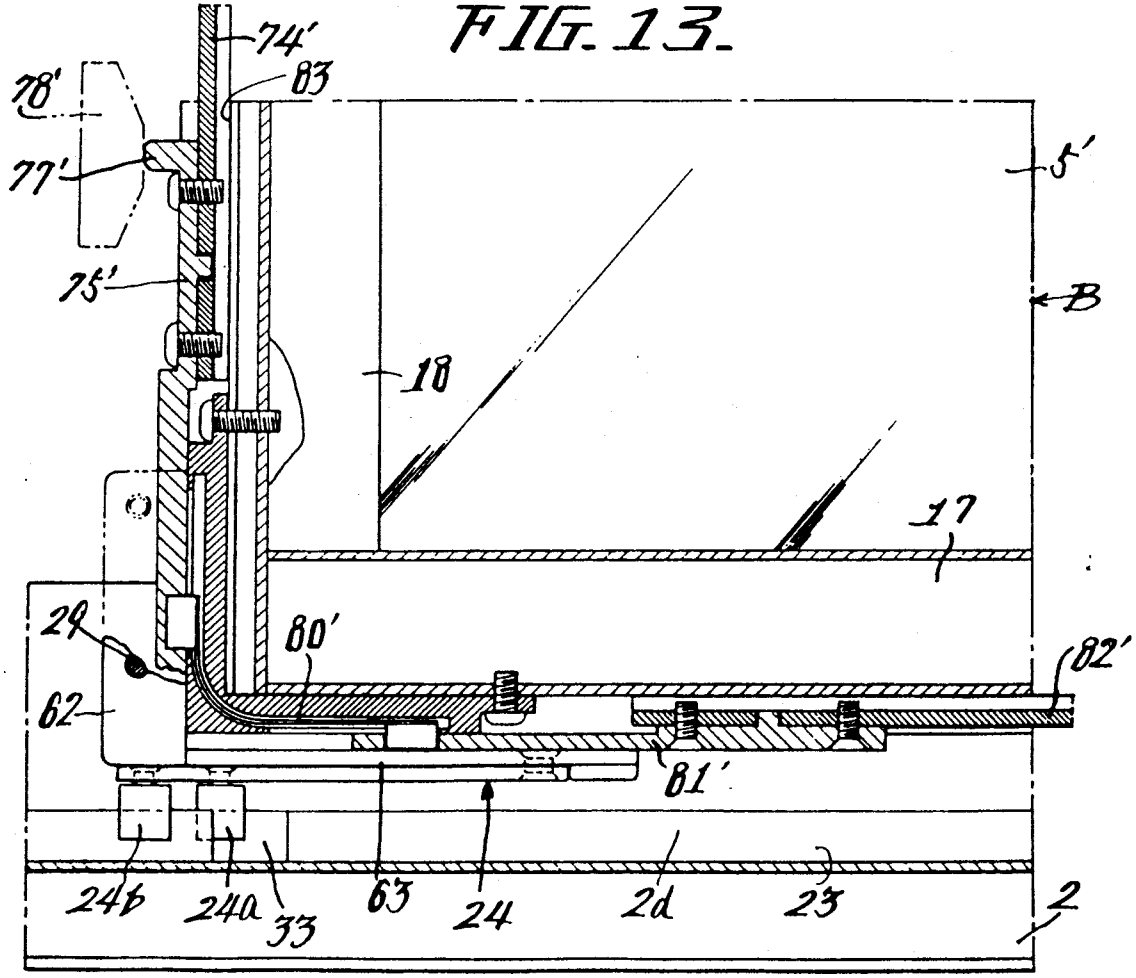
FIG. 13 is a cross-sectional view taken along line 10C—10C of FIG. 10.

In the same way as when the horizontally moving upper frame 82 is engaged with the horizontal upper guide groove 83', the horizontally moving lower frame 82' is engaged with a horizontal lower guide groove 83'' in which a piece 17*c* of the lower rail 17 which comes in and out of contact with the second air- and water-tight material 15, forms an external wall (see FIGS. 13 and 19). A lower intermediate drawing piece 84' is attached at the center of the horizontally moving lower frame 82'.

Figure 21:
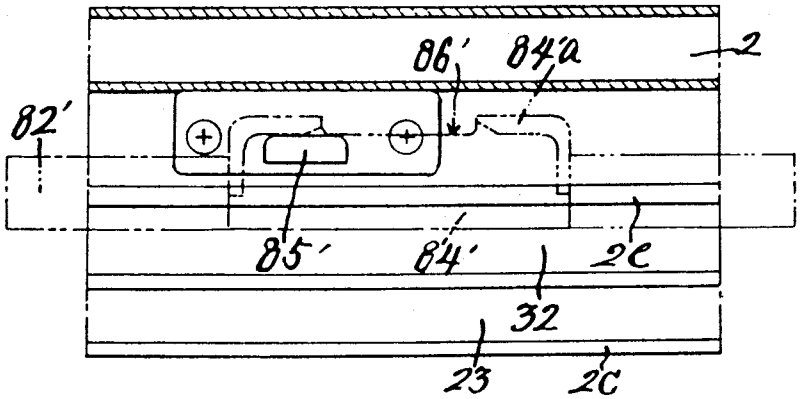
FIG. 21 is a cross-sectional view taken along line 19B—19B of FIG. 19.

As shown in FIGS. 19 and 21, the lower intermediate drawing piece 84' is constructed in a manner similar to that of the upper intermediate drawing piece 84. It has a falling piece 84'*a* on the external side thereof. A doorway cut-away section 86' of a receiving piece 85' for the lower intermediate drawing piece is provided at the center of the falling piece 84'*a*.

The receiving piece 85' for the lower intermediate drawing piece is arranged, in a vertical direction, symmetrically with the receiving piece 85 for the upper intermediate drawing piece. The receiving piece 85' for the lower intermediate drawing piece is positioned substantially in the middle of the door edge hard frame 3 and the mullion 4 of the sill 2, and stands on the sill 2 in the vicinity of the sill receiving piece 2b (see FIG. 19).

Figure 25:
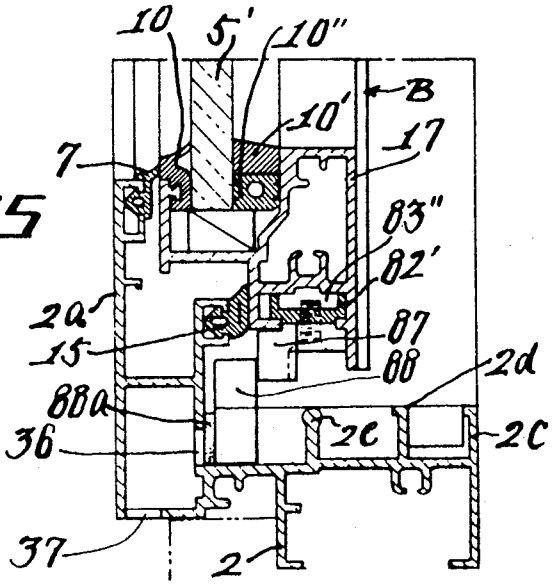
FIG. 25 is a cross-sectional view taken along line 1K—1K of FIG. 1.

The front end of the horizontally moving lower frame 82' extends on the side of the hard rail 18'. A pressed piece 87, having inclined faces 87', 87' inclining toward the hard frames 3, 3' on the external end thereof, is attached to the end of the frame 82' (see FIG. 25).

The pressed piece 87 comes in or out of contact, in response to the horizontal movement of the horizontally moving lower frame 82', with the internal face of a closed cover 88 for the drainage hole 36. As illustrated in FIG. 24, the closed cover 88 has an elastic piece 88a on the external end thereof, and is arranged while being energized in the open direction by a spring 88. One end of the spring 88 is rotatably fixed to the sill 2.

Figure 6:
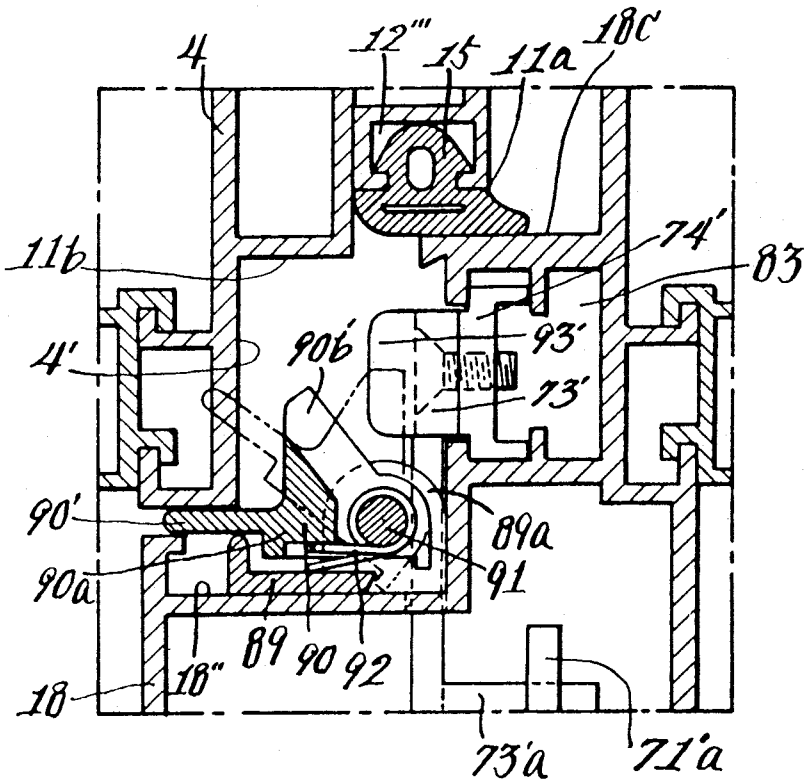
FIG. 6 is a partially enlarged view of FIG. 5.

Numeral 89 in the drawings indicates a support piece which is arranged at the vertical center of the face 18'' opposite to the mullion 4 in the meeting stiles 18. The meeting stiles 18 are always positioned on the internal side of the above-described fixed section F (see FIGS. 5, 6 and 7). The base of a regulating portion 90 is interposed between a pair of horizontal pieces 89a of the support piece 89. The regulating portion 90 is rotatably fixed, with the aid of a shaft 91, to the horizontal pieces 89a, 89a.

The regulating portion 90 is made of a somewhat groove-like frame composed of a central piece 90a, and regulating pieces 90b, 90b', which vertically connects to the central piece 90a. A projected piece 90', which extends vertically, is provided on the outside of the central piece 90a. As described above, the end sides of the regulating pieces 90b, 90b' are rotatably fixed to the support piece 89 with the aid of the shaft 91. The regulating portion 90 is rotatably energized by coiled spring 92 which is wound around the shaft 91 in a clockwise direction of FIG. 5. In other words, the regulating portion 90 is energized in a direction in which the projected piece 90' faces the mullion 4; that is, in a direction in which the projected piece 90' moves away from the face 18'' opposite to the mullion 4. Because of the force acting on the coiled spring 92, the regulating pieces 90b, 90b' are positioned so as to be on the vertical tracks of the upper and lower intermediate pieces 73, 73' mentioned above. A receiving piece 93 for the upper regulating piece, which stops the upper regulating piece 90b, is provided on the lower end of the upper intermediate piece 73 so as to protrude in the direction of the mullion 4. Similarly, a receiving piece 93' for the lower regulating piece, which stops the lower regulating piece 90b', is provided on the upper end of the lower intermediate piece 73' so as to protrude in the direction of the mullion 4.

Moreover, as shown in FIG. 2, a roller frame 94 is provided in an appropriate place of the door edge hard frame 3 on the internal side so as to be overlapped by the receiving piece 3b in the internal and the external directions. An auxiliary roller 94a, which presses an interior piece 18'b of the hard rail 18', is rotatably fixed to the roller frame 94.

Figure 4:
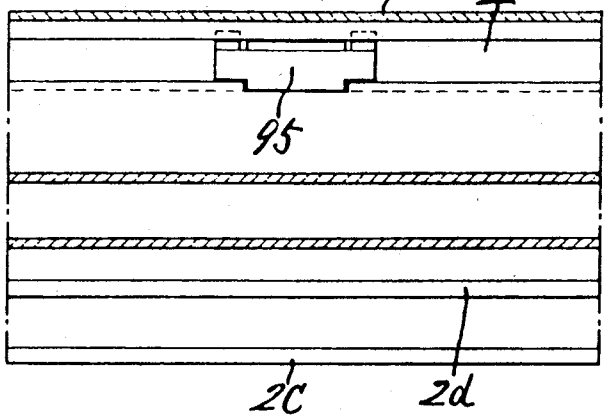
FIG. 4 is a cross-sectional view taken along line 3A—3A of FIG. 3.

A member indicated by numeral 95 in FIGS. 3 and 4 is a spacer to obtain the fixed section F.

The operations of the various components will now be described.

Figure 5:
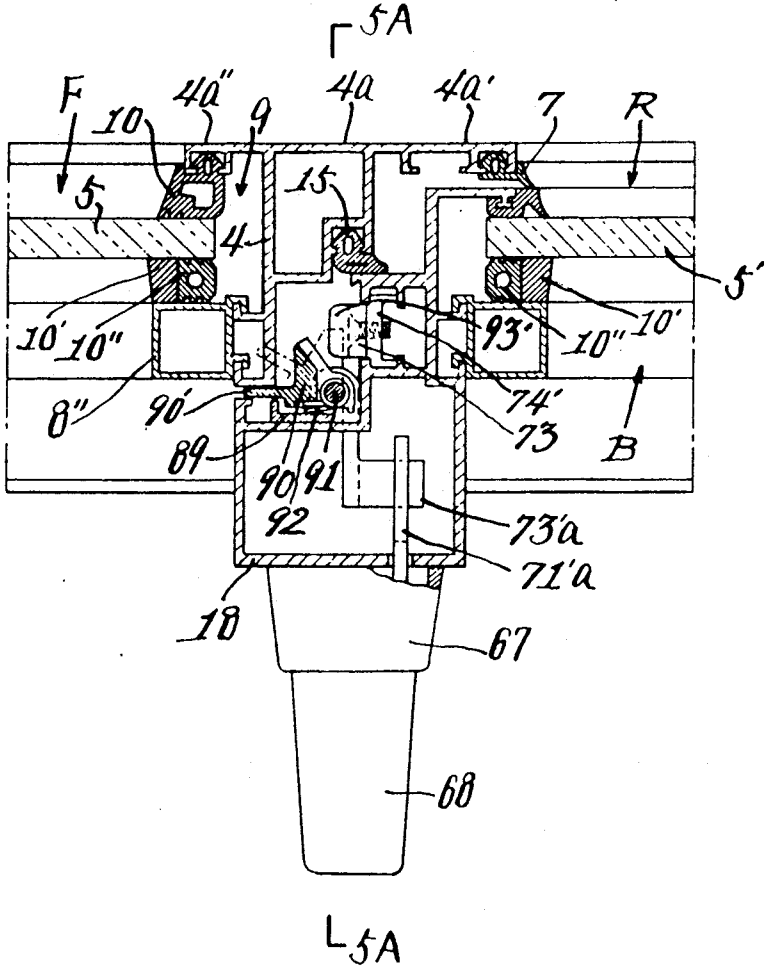
FIG. 5 is a cross-sectional view taken along line 1C—1C of FIG. 1.

FIG. 8, 22, 23 or 24 shows the state where the sliding door B is completely or partially opened. Under such conditions, as indicated by chain lines in FIGS. 5, 6 and 7, the regulating portion 90 rotates by the force acting on the coiled spring 92. It rotates on the shaft 91 clockwise as shown in FIG. 5. The upper regulating piece 90b of the regulating portion 90 is stopped by the receiving piece 93 for the upper regulating piece. On the other hand, the lower regulating piece 90b' of the regulating portion 90 is stopped by the receiving piece 93' for the lower regulating piece. As a result, the upward movement of the upward moving frame 74 is regulated. The upward moving frame 74 is attached, with the aid of the upper intermediate piece 73, to the receiving piece 93 for the upper regulating piece. On the other hand, the downward movement of the downward moving frame 74' is also regulated. The downward moving frame 74' is attached, with the aid of the lower intermediate piece 73', to the receiving piece 93' for the lower regulating piece. In other words, although the upper and lower intermediate pieces 73, 73' are linked to the pinion 70 by means of the upper and lower racks 71, 71', the knob 68 will not rotate because of the above-described regulation, even if one may try to rotate the knob 68 accidentally.

On the other hand, the sliding door support piece 41 is prevented from rotating because a lower end 44'' of the first stopper 44 is stopped by the internal end face of the base 41' of the sliding door support piece 41, and because the second stopper 49 is stopped by the projected strip 55. Accordinaly, in the same manner as with the side of meeting stiles 18 (door rear edge), a fixed space between the sash pulley 21 on the front edge of the door and the sliding door hard rail 18' (door front) is maintained, thereby regulating the rotations of the arm piece 61 of the upper guide member 22, the arm piece 64 of the lower guide member 24 on the side of the meeting style, and the arm piece 65 of the lower guide member 25 on the front edge of the door.

Under the above conditions, when the sliding door B travels in the direction of the door edge hard frame 3, that is, in the closed direction, the wheels 20a of the sash pulley 20 on the side of the meeting style, and the wheels 21a of the sash pulley 21 on the front edge of the door, travel along the upper guide rails 19. The roller 22a of the upper guide member 22 travels through the guide space 26, and advances into the bend space 30. Also, the rollers 24a, 24b of the lower guide member 24 on the side of the meeting style travel along the lower guide rails 31. (As shown in FIG. 16, the first roller 24a travels to the doorway cut-away section 33.) The roller 25a of the lower guide member 25 on the front edge of the door travels along the lower guide rails 31, and advances into the bend rails 34. The interior piece 18'b of the hard rail 18' of the sliding door B is brought into contact with the auxiliary roller 94a. As partially illustrated in FIGS. 15 and 16, the sliding door B is arranged so as to cross the window frame A.

At this time, the upper end 44' comes in contact with the projected edge 54, whereby the first stopper 44 falls against the coiled spring 43, and comes off the internal end face of the base 41' of the sliding door support piece 41. At the same time, the sliding door support frame 60, that is, the hard rail 18' is caused to be capable of traveling in the direction of the sash pulley 21 on the front edge of the door, thereby releasing the restriction of the arm pieces 61, 63, 65.

When the operation knob 68 is pressed in order to press the meeting stiles 18 in the external direction, that is, in the direction of the mullion 4, the first roller 24*a* of the lower guide member 24 on the side of the meeting style travels through the doorway cut-away section 33 into the grooves 32. The hard rail 18' stays momentarily between the auxiliary roller 94*a* and the receiving piece 3*b* of the hard frame 3 on the front edge of the door. The projected piece 90' is stopped by the internal end face of the mullion 4, whereby the regulating portion 90 is caused to rotate against the coiled spring 92. The regulating pieces 90*b*, 90*b'* of the regulating portion 90 release the restriction of the receiving pieces for the upper and lower regulating pieces. The rotation of the operation knob 68 is thus made possible.

Furthermore, when the operation knob 68 is rotated, the pinion 70 attached to the rotary shaft 69 rotates, thereby causing the upper and lower racks 71, 71' to move vertically. Because of the ascent of the upper rack 71, the upward moving frame 74 ascends with the aid of the upper intermediate piece 73. The upward drawing member 75 connected to the upward moving frame 74 also ascends. The upward separating projection 77, provided on the upward drawing member 75, comes in contact and overlaps with the upper separate receiving piece 78. Moreover, because of the descent of the lower rack 71', the downward moving frame 74' descends with the aid of the lower intermediate piece 73'. The downward drawing member 75' connected to the downward moving frame 74' also descends. The downward separating projection 77', provided on the downward drawing member 75', comes in contact and overlaps with the lower separate receiving piece 78'. The hard rail 18' is inserted into the space between the auxiliary roller 94*a* and the receiving piece 3*b* by virtue of the fact that the upward separating projection 77 comes in contact and overlaps with the upper separate receiving piece 78, and also by virtue of the fact that the downward separating projection 77' comes in contact and overlaps with the lower separate receiving piece 78'. The sliding door B thus stands between the mullion 4 and the door edge hard frame 3. In other words, the position of the sliding door B changes so as to face in the external direction, and closes the open section R.

Moreover, as shown in FIG. 10 or 11, because of the ascent of the upper drawing member 75, the upward drawing piece 76, attached to the upper drawing member 75, is brought into contact with the upward drawing roller 40. Furthermore, as shown in FIG. 11, because of the descent of the lower drawing member 75', the downward drawing piece 76', attached to the lower drawing member 75', is brought into contact with the second intermediate piece 2*e* of the sill 2. As a result, the upper and lower parts of the meeting stiles 18 of the sliding door B are drawn. (Thus side of the hard rail 18' is drawn toward the side of the receiving piece 3*b* of the door edge hard frame 3 by virtue of the fact that the side of the hard rail 18' is pressed into contact with the auxiliary roller 94.) Also, the intermediate section of the meeting stiles 18 is drawn toward the external direction due to the fact that the upper and lower intermediate drawing rollers 79, 79' are pressed into contact with the intermediate drawing pieces 13, 13'. The upper and lower intermediate drawing rollers 79, 79' are arranged on the upward and downward moving frames 74, 74'. The intermediate drawing pieces 13, 13' are disposed on the inner face 4' of the mullion 4.

As the upper drawing member 75 ascends, the horizontally moving upper frame 82 advances, with the aid of the upper leaf spring 80, in the direction of the hard rail 18' (the door edge hard frame 3). By the operation in which the sliding door B is pressed so that its position changes to face in the external direction, the upper intermediate drawing piece 84, attached to the horizontally moving upper frame 82, is pressed into contact with the external side face of the upper intermediate drawing piece 85. The upper intermediate drawing piece 85 is positioned, with the aid of the doorway cut-away section 86, on the internal side of the rising piece 84*a*. Furthermore, as the lower drawing member 75' descends, the horizontally moving lower frame 82' advances, with the aid of the lower leaf spring 82, in the direction of hard rail 18' (the door edge hard frame 3). By the operation in which the sliding door B is pressed so that its position changes to face in the external direction, the lower intermediate drawing piece 84', attached to the horizontally moving lower frame 82', is pressed into contact with the external side face of the lower intermediate drawing piece 85'. The lower intermediate drawing piece 85' is positioned, with the aid of the doorway cut-away section 86', on the internal side of the falling piece 84*a*. Due to the pressure contact mentioned above, the intermediate sections of the upper and lower rails 16, 17 of the sliding door B are drawn in the external direction.

As illustrated in FIG. 2 or 19, by joining together various components mentioned above, it is possible to obtain the air- and water-tight conditions on the external side by virtue of the fact that the end 7' of the first air- and water-tight material 7 contacts the dry air- and water-tight material 10 of the sliding door B. The first air- and water-tight material 7 is provided so as to cover the open section R, and is arranged respectively on the exterior piece 1*a* of the head 1, the exterior piece 2*a* of the sill 2, the exterior piece 3*a* of the door edge hard frame 3, and the exterior piece 4*a* of the mullion 4. Moreover, it is also possible to obtain the air- and water-tight conditions on the internal side by virtue of the fact that the ends 15' of the second air- and water-tight materials 15 contact the piece 16*c* of the upper rail 16, the piece 17*c* of the lower rail 17, the piece 18*c* of the meeting stiles 18, and a piece 18'*c* of the hard rail 18'. All of the above-mentioned pieces are attached to the sliding door B. The second air- and water-tight materials 15 are attached respectively to the receiving piece 1*b* of the head 1, the receiving piece 2*b* of the sill 2, the receiving piece 3*b* of the door edge hard frame 3, and the first step 11*a* of the mullion 4.

In addition, the pressed piece 87, attached to the horizontally moving lower frame 82', presses against the closed cover 88, which closes the drainage hole 36.

As has been described above, it is possible to close the open section R by means of the sliding door B. As shown in FIG. 2, when it is closed, the sliding door B is arranged flush with the fixed section F, whereby the outward appearance of the single sliding sash according to the present invention becomes similar to that of a fixed window.

The open section R can be opened owing to the fact that the various components mentioned above return to their original positions by operating the operating knob 68. The opening operation is the same as that for the closing operation mentioned above, except the procedures of the closing operation are reverse. The explanation of the opening operation, therefore, will be omitted.

What is claimed is:

1. A sash assembly for a window frame including a horizontally sliding door which is positioned on an internal side of a fixed section of said sash assembly when open and which closes an open section of said sash assembly when closed, said sash assembly comprising:

a frame having a top and a bottom edge element and a first and a second side edge element, said fixed section of said frame being delimited by said first side element, said top element, said bottom element and a central element; the open section of said frame being delimited by said central element, said top element, said bottom element and said second side element;

said central element defining the rear of said open section and the second side element defining the front of said open section;

an upper guide track coupled to said top element of said frame; a bottom guide track coupled to said bottom element of said frame; said upper and lower guide tracks each having a straight portion and a curved portion, said straight portion lying in a plane parallel to and in spaced relation from said fixed section on the internal side thereof;

said curved portion extending from said straight portion toward said second side element and terminating adjacent to the front of said open section;

a sliding door for closing said open section and having a top and a bottom edge and a front and a rear end; means in spaced relation to said second side element engageable with the front end of said door as said door is moved to the closed position for forcing said door into sealing engagement with said second element; and a plurality of sliding guide members pivotally coupled to respective ones of said top and bottom edges of said door adjacent the front end thereof and lying within the perimeter of said door, said guide members positioned in said upper and lower guide tracks for guiding said door along said upper and lower guide tracks to permit movement of said door along said straight and curved portions, whereby said curved portion causes movement of the front end of said door toward said front of said open section to position said door in co-planar relationship with said closed section when closing said open section, and a lower support member pivotally connected to the bottom edge of said door adjacent the rear end and lying within the perimeter of said door, said lower support member comprising lower roller means pivotally connected with said bottom guide track, said bottom guide track having an opening therein to permit movement of said lower roller means therethrough when said door is pivoted about the lower roller means connection to the closed position.

2. The sash assembly according to claim 1, wherein said straight portions of the upper and lower guide tracks are formed of a pair of guide rails and said curved portion is formed of an auxiliary block.

3. The sash assembly according to claim 1, wherein said sliding guide members include a pair of sash pulleys and upper guide arm pieces coupled to said top edge of said door.

4. A sash assembly as in claim 1, in which said second element comprises a sealing member engageable with said door when said door is moved to the closed position.

5. A sash assembly as in claim 1, in which said upper guide track comprises a channel having opposed flanges extending toward each other, and said guide member coupled to said top edge comprising rotatable members engaging said flanges to rotatably support said door on said channel.

6. A sash assembly as in claim 1, and an upper support member pivotally connected to the top edge of said door adjacent the rear end, said upper support member comprising roller means connected with said upper guide track, and an opening in said track receiving said roller means therethrough when said door is moved to the closed position.

* * * * *